US007111333B1

(12) United States Patent
Lo et al.

(10) Patent No.: US 7,111,333 B1
(45) Date of Patent: Sep. 26, 2006

(54) TOILET STRUCTURE

(75) Inventors: Tsung-Yi Lo, Taichung (TW); Jin-Yi Wang, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 11/281,467

(22) Filed: Nov. 18, 2005

(30) Foreign Application Priority Data

Sep. 29, 2005 (TW) ..... 94216773 U

(51) Int. Cl.
*E03D 11/00* (2006.01)

(52) U.S. Cl. ..... 4/420; 4/425; 4/421; 4/428

(58) Field of Classification Search ..... 4/420, 4/421, 425, 428
See application file for complete search history.

(56) References Cited

U.S. PATENT DOCUMENTS 5,283,913 A * 2/1994 Jaeckels ..... 4/423
6,145,138 A * 11/2000 Nakamura et al. ..... 4/425
6,415,457 B1 * 7/2002 Schmucki ..... 4/423
2003/0115664 A1 * 6/2003 Kosugi et al. ..... 4/420

FOREIGN PATENT DOCUMENTS

GB 2045311 A * 10/1980 ..... 4/420

* cited by examiner

*Primary Examiner*—Khoa D. Huynh
(74) *Attorney, Agent, or Firm*—Browdy and Neimark, PLLC

(57) ABSTRACT

A toilet includes a bowl having a receiving portion, a converging portion in front of the receiving portion, an injecting portion and an inlet portion at opposite ends of the converging portion, and a discharging pipe behind the receiving portion and communicated with the receiving portion. The bowl has an inlet at an end thereof to communicate outside, two down tunnels on opposite side of the bowl with ends communicated with the inlet and ends extended downwards to a position in front of the receiving portion. Each of down tunnels has a U-turn section that the down tunnels have inward U-turns and are communicated with the converging portion, such that water flowing through the down tunnels will converge together in the converging portion for injecting to the discharging pipe.

8 Claims, 5 Drawing Sheets

TOILET STRUCTURE

BACKGROUND OF THE INVENTION

1. Field of the Invention

The present invention relates generally to an apparatus for bathroom, and more particularly to a toilet, which is flushed by normal flush and siphon effect.

2. Description of the Related Art

Typically, conventional toilets are classified into two types. The first type is shown in FIG. 1. The toilet includes a bowl member 1 with a drain tunnel 2 and a flood tunnel 3. The flood tunnel 3 and the drain tunnel 2 are located at a side the same side. The flood tunnel 3 is communicated with a tank. Water flows from the tank and downward to the bowl and makes a whirlpool in the flood tunnel 3 to flush the waste by siphon principle. Such toilet only applies siphon effect, such that it has a weak flushing power and needs much water for flush. The toilet provides a worse flushing performance and waste money.

The second toilet is shown in FIG. 2. The toilet includes a U-turn pipe 4 from the tank and extended downwards. The pipe 4 has an outlet aligned with a drain tunnel 5 directly to enhance the flushing power. Water flowing through the pipe 4 and making a U-turn can provide a well performance and save water. When water makes the U-turn, the centrifugal force makes water flow faster at distal side of the turn than at proximal side of the turn, as shown in FIG. 3. As a result, the water flow only flushes the margin of the waste but the center (or the center of gravity). It still has the condition of whirlpool, spinning and weak flushing power that can't flush the waste out efficiently.

SUMMARY OF THE INVENTION

The primary objective of the present invention is to provide a toilet with greater flushing power and less water need.

According to the objective of the present invention, a toilet comprises a bowl having a receiving portion, a converging portion in front of the receiving portion, an injecting portion and an inlet portion at opposite ends of the converging portion, and a discharging pipe behind the receiving portion and communicated with the receiving portion. The bowl has an inlet at an end thereof to communicate outside, two down tunnels on opposite side of the bowl with ends communicated with the inlet and ends extended downwards to a position in front of the receiving portion. Each of down tunnels has a U-turn section that the down tunnels have inward U-turns and are communicated with the converging portion, such that water flowing through the down tunnels will converge together in the converging portion for injecting to the discharging pipe.

DETAILED DESCRIPTION OF THE INVENTION

Figure 1:
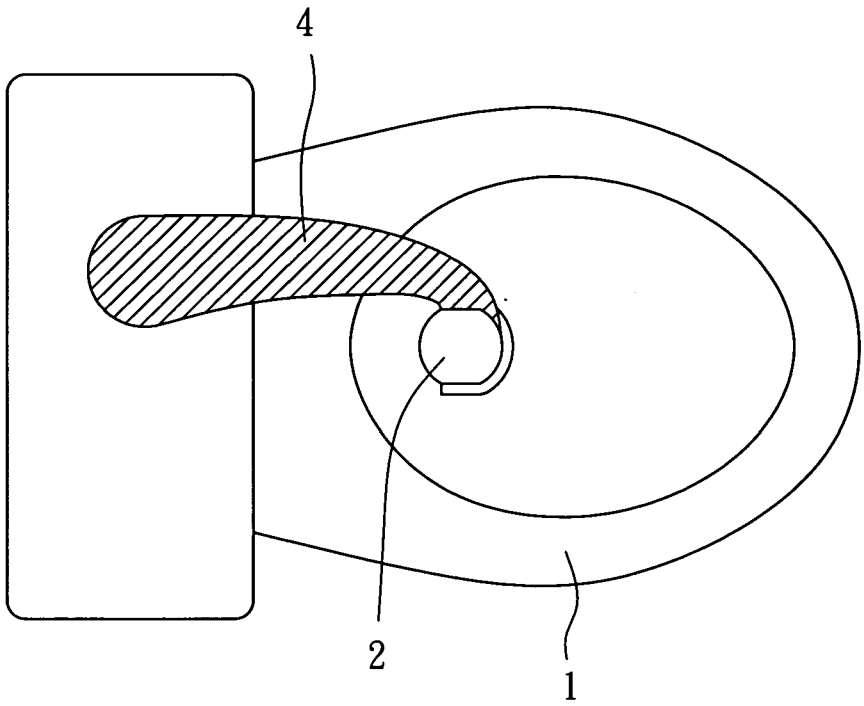
FIG. 1 PRIOR ART
FIG. 1 is a top view of the first conventional toilet.
Figure 2:
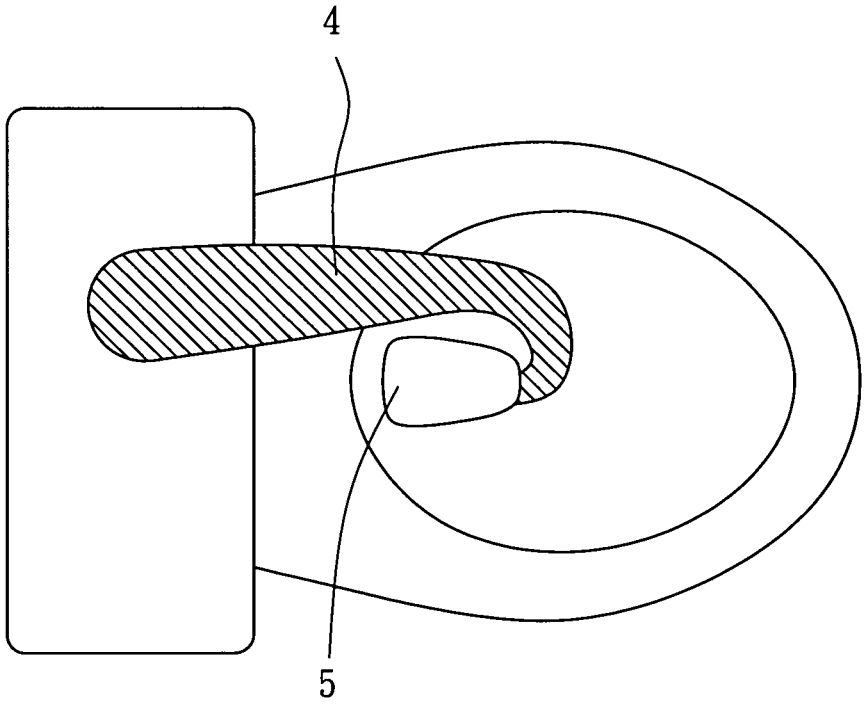
FIG. 2 PRIOR ART
FIG. 2 is a top view of the second conventional toilet.
Figure 3:
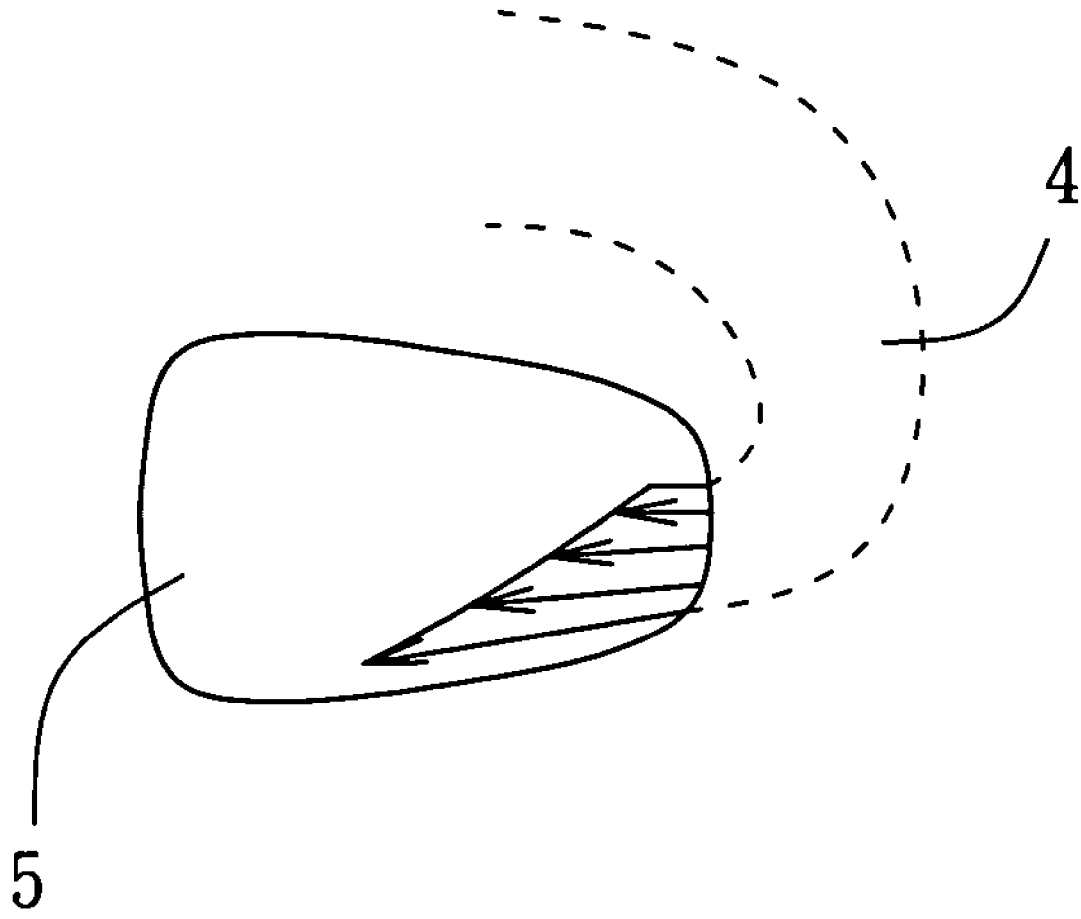
FIG. 3 PRIOR ART
FIG. 3 is a sketch diagram of the second conventional toilet, showing the water flow.
Figure 4:
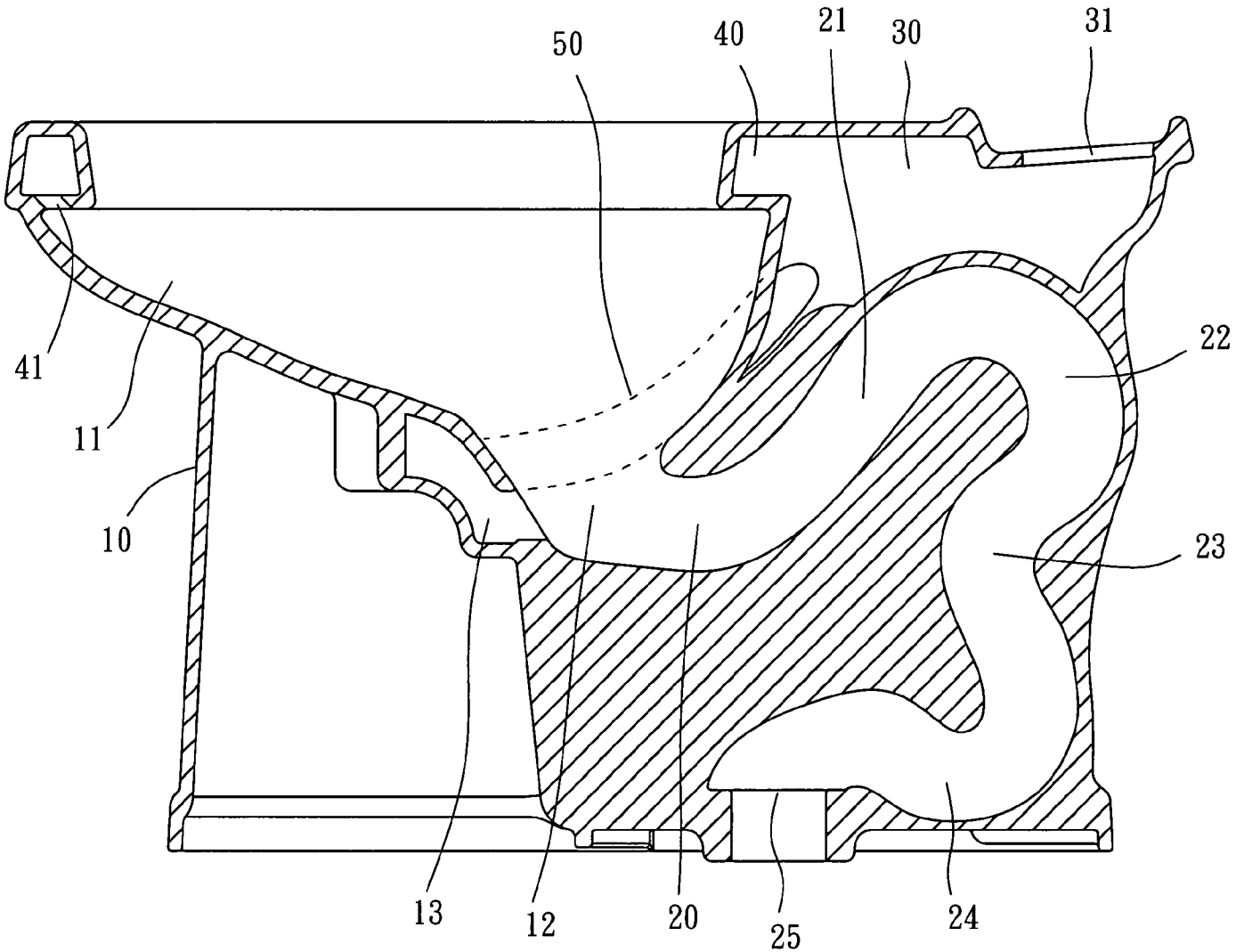
FIG. 4 is a sectional view of a lateral side of a preferred embodiment of the present invention.
Figure 5:
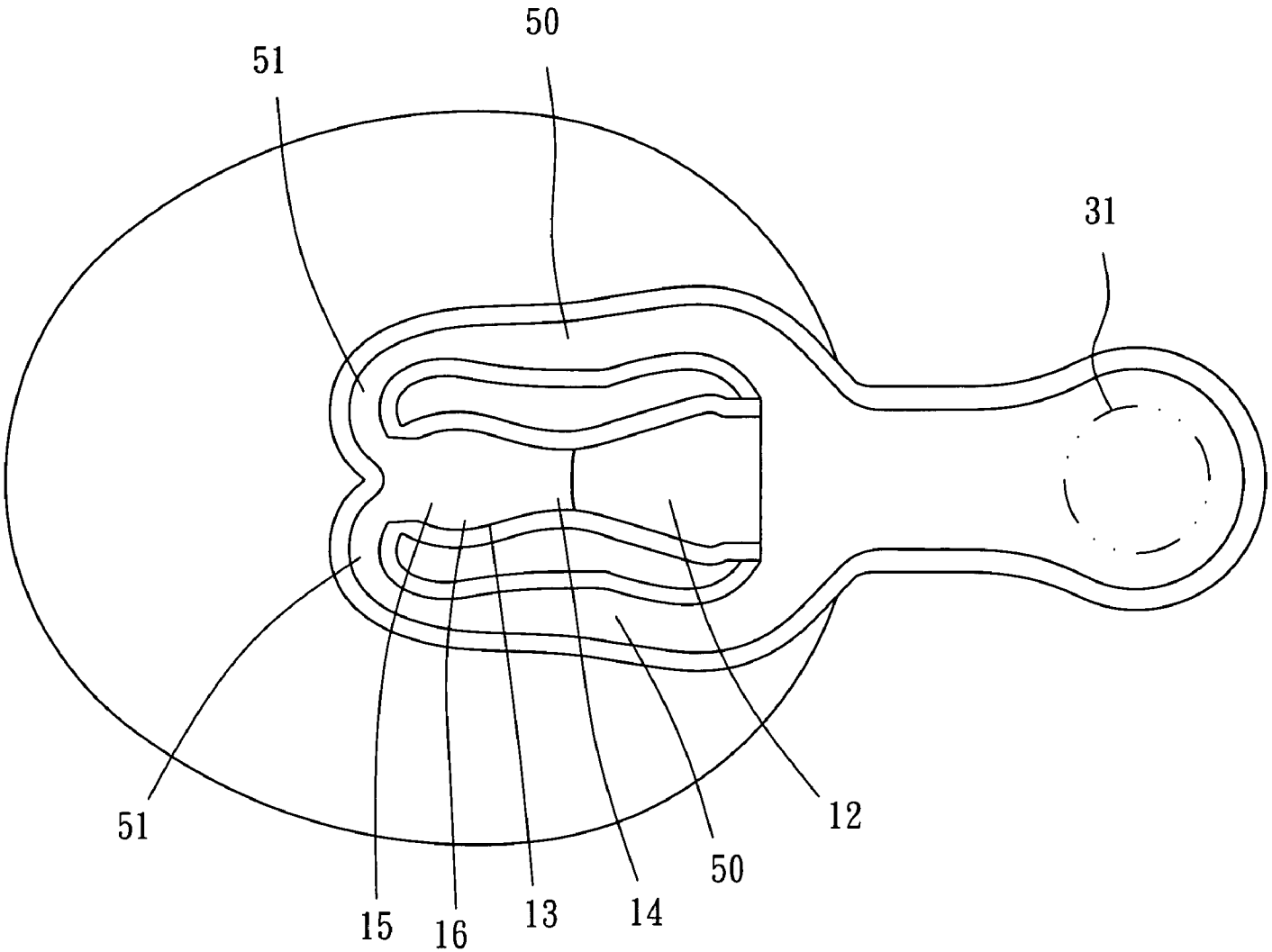
FIG. 5 is a bottom view of the preferred embodiment of the present invention.
Figure 6:
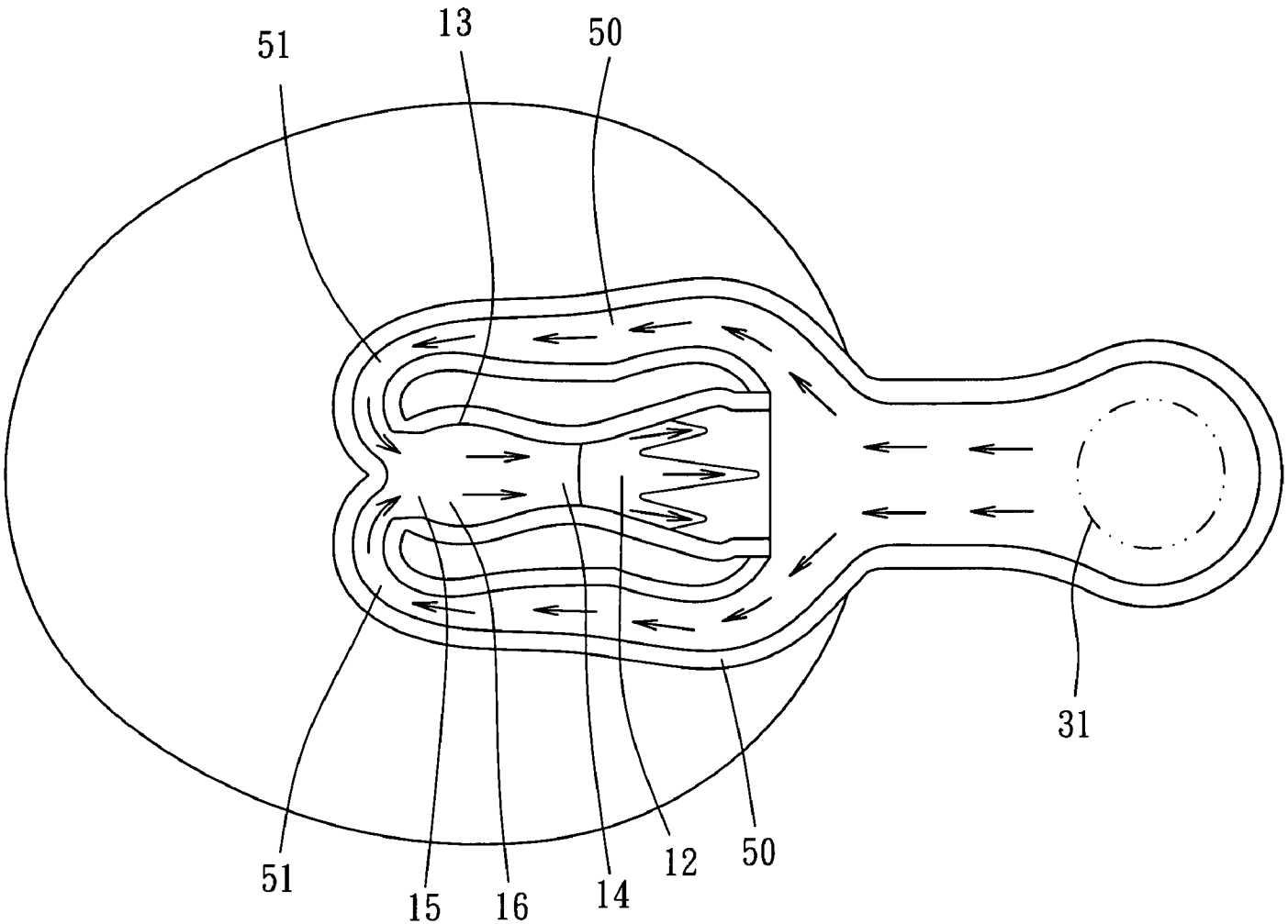
FIG. 6 is a sketch diagram of the preferred embodiment of the present invention, showing the water flow.

As shown in FIG. 4 and FIG. 5, a toilet of the preferred embodiment of the present invention comprises:

A bowl member 10 has a contraction portion 11, which is narrowed from a top to a bottom thereof, a receiving portion 12 below the contraction portion 11, and a converging portion 13 in front of the receiving portion 12. The converging portion 13 has an injecting portion 14 and an inlet portion 15 at opposite ends thereof with a narrow interior diameter and a wider converging region 16 is at a center thereof. Behind the receiving portion 12 is a discharging pipe 20 and is communicated therewith. The discharging pipe 20 has a rising section 21, a falling section 22, a twisted section 23, a gathering section 24, and an outlet 25 in sequence. Water flow goes up in the rising section 21 and goes down in the falling section 22. The twisted section 23 is curved toward the receiving portion 12 first and curved back. Finally, the water flow goes out via the gathering section 24 and the outlet 25. Water forms a turbulent flow in the twisted section 23 and produces the siphon effect in the gathering section 24 to suck the waste and water in the receiving portion 12 out.

The bowl 10 has a chamber 30 at an end thereof with an inlet 31 to be communicated with a tank (not shown in FIG). Water comes from the tank flows into the chamber 30 via the inlet 31. The bowl 10 has an annular up tunnel 40 at a top thereof. The up tunnel 40 is communicated with the chamber 30 and has bores 41 to flow the water in the chamber 30 to the contraction portion 11.

The bowl 10 has two down tunnels 50 at opposite sides of the contraction portion 11. The down tunnels 50 have ends communicated with the chamber 30 to flow the water in the tank to the down tunnels 50 via the chamber 30. Each of the down tunnels 50 have the other end extended downwards to a position in front of the receiving portion 12 to form a U-turn section 51. The down tunnels 50 make an inward U-turn, with an angle greater than 90 degree and less than 180 degree, and are communicated with the inlet portion 15 of the converging portion 13. Water flowing through the down tunnels 50 will go to the converging portion 13 first and converge together to go to the discharging pipe 20.

In a normal condition, the receiving portion 12 and the converging portion 13 are under the water. When user flushes the toilet of the present invention, water in the tank flows to the chamber 30 via the inlet 31 first, and then a part of the water flows through the up tunnel 40 and the bores 41 and to the contraction portion 11 and finally arrive the receiving portion 12 to wash the waste on the contraction portion 11. The other part of the water flows through the down tunnels 50 respectively and converges in the converging portion 13 and flows to the injecting portion 14 to inject toward the discharging pipe 20. The present invention provides two water flows converging together before injecting out so that the present invention has no the conventional condition that water flow goes faster at the exterior side and slower at the interior side when it makes a turn. The present invention has two water flows converging together naturally and with a mountain peaks-like distribution, with the mountain peaks pointing the discharging pipe 20 and spreading out, in the receiving portion 12. As a result, the present invention can flush the waste out directly, normally, and efficiently. In the discharging pipe 20, the siphon effect is working to provide a well flushing power.

In addition, the present invention further provides a narrowed injecting portion 14 behind the converging flow.

According to the fluid mechanics, the quantity of water flowing in is equal to the quantity of water flowing out, such that water flows through the narrowed injecting portion 14 will have a faster speed that will increase the flushing power.

What is claimed is:

1. A toilet, comprising:

a bowl having a receiving portion, a converging portion in front of the receiving portion, an injecting portion and an inlet portion at opposite ends of the converging portion, and a discharging pipe behind the receiving portion and communicated with the receiving portion; the bowl having an annular up tunnel at a top thereof and an inlet at an end thereof to communicate outside, two down tunnels on opposite sides of the bowl with ends communicated with the inlet and ends extended downwards to a position in front of the receiving portion, wherein each of down tunnels has a U-turn section that the down tunnels have inward U-turns and are communicated with the converging portion, such that water flowing through the down tunnels converge together in the converging portion for injecting to the discharging pipe.

2. The toilet as defined in claim 1, wherein the converging has a converging region between the injecting portion and the inlet portion that interior diameters of the injecting portion and the inlet portion are smaller than that of the converging region.

3. The toilet as defined in claim 1, wherein the U-turn section of the down tunnel has an angle greater than 90 degree and less than 180 degrees.

4. The toilet as defined in claim 1, wherein the bowl has a chamber at an end thereof communicated with the inlet.

5. The toilet as defined in claim 4, wherein the bowl has the annular up tunnel at the top thereof communicated with the chamber and bores on the up tunnel to flow water in the chamber to the receiving portion via the up tunnel and the bores.

6. The toilet as defined in claim 1, wherein the bowl has a contraction portion narrowed front a top to a bottom thereof, below which the receiving portion is provided.

7. The toilet as defined in claim 6, wherein the down tunnels are located at opposite sides of the contraction portion.

8. The toilet as defined in claim 7, wherein the discharging pipe has a rising section, which goes upwards, a falling section, which goes downwards, a twisted section, which is curved toward the receiving portion and curved back, a gathering section, and an outlet in sequence, wherein water forms a turbulent flow in the twisted section and produces the siphon effect in the gathering section to suck a waste in the receiving portion out.

* * * * *